US008061040B2

(12) United States Patent
Walls

(10) Patent No.: US 8,061,040 B2
(45) Date of Patent: Nov. 22, 2011

(54) CUTTER BLADE ASSEMBLY AND DRY SHAVER FOR VARIABLE HEIGHT OF CUT

(76) Inventor: Patrick Joseph Walls, Dublin (IE)

( * ) Notice: Subject to any disclaimer, the term of this patent is extended or adjusted under 35 U.S.C. 154(b) by 0 days.

(21) Appl. No.: 12/126,198

(22) Filed: May 23, 2008

(65) Prior Publication Data

US 2008/0313910 A1 Dec. 25, 2008

Related U.S. Application Data

(63) Continuation of application No. PCT/IE2006/000132, filed on Nov. 24, 2006, which is a continuation-in-part of application No. 10/467,689, filed on Jan. 25, 2005, now abandoned.

(30) Foreign Application Priority Data

Nov. 24, 2005 (IE) ..... S2005/0781
Dec. 23, 2005 (IE) ..... S2005/0873

(51) Int. Cl.
*B26B 19/20* (2006.01)

(52) U.S. Cl. ..... 30/43.6; 30/43; 30/43.4

(58) Field of Classification Search .... 30/43, 43.1–43.9, 30/43.91, 346.51, 43.92
See application file for complete search history.

(56) References Cited

U.S. PATENT DOCUMENTS

| | | | | |
|---|---|---|---|---|
| 2,345,263 | A | 3/1944 | Jepson | |
| 3,138,866 | A | 6/1964 | Ressler | |
| 3,564,715 | A | 2/1971 | Driessen et al. | |
| 3,694,916 | A | 10/1972 | Harms et al. | |
| 4,003,390 | A * | 1/1977 | Solie | 132/213 |
| 4,085,503 | A | 4/1978 | Beck et al. | |
| 5,185,933 | A | 2/1993 | Messinger | |
| 5,625,950 | A | 5/1997 | Sterk et al. | |
| 5,867,908 | A | 2/1999 | Van Veen et al. | |
| 5,901,446 | A | 5/1999 | Szymansky | |
| 2001/0039734 | A1 * | 11/2001 | Kadijk et al. | 30/43.6 |

FOREIGN PATENT DOCUMENTS

| | | | |
|---|---|---|---|
| CH | 234183 | C | 9/1944 |
| DE | 901510 | C1 | 1/1954 |
| DE | 4031871 | C1 | 12/1991 |
| EP | 0484795 | A1 | 5/1992 |
| EP | 1231034 | A1 | 8/2002 |
| WO | 9602368 | A1 | 2/1996 |
| WO | 9745235 | A1 | 12/1997 |
| WO | 9835794 | A1 | 8/1998 |
| WO | 9914019 | A1 | 3/1999 |

OTHER PUBLICATIONS

International search report issued in corresponding PCT/IE2006/000132, dated Apr. 13, 2007.

* cited by examiner

*Primary Examiner* — Phong H Nguyen
(74) *Attorney, Agent, or Firm* — Kusner & Jaffe

(57) ABSTRACT

A dry shaver unit includes a housing and a cutter blade assembly mounted in the housing. The cutter blade assembly includes a cutter blade and cooperating shear blade arrangement. The thickness of the shear blade varies over its surface, such that the spacing between a portion of the skin engaging surface of the shear blade and the opposite face thereof is increased as compared with the spacing required to achieve a "close shave". The cutter blade assembly is mounted in the housing such that a plurality of portions of the shear blade having different thicknesses are simultaneously available for application to a surface to be shaved.

10 Claims, 9 Drawing Sheets

CUTTER BLADE ASSEMBLY AND DRY SHAVER FOR VARIABLE HEIGHT OF CUT

CROSS-REFERENCE TO RELATED APPLICATIONS

This is a continuation of, and claims priority from, PCT Application Number PCT/IE2006/000132 filed on Nov. 24, 2006 which claims priority from IE S2005/0781 filed Nov. 24, 2005 and IE S2005/0873 filed Dec. 23, 2005 and is a continuation-in-part of, and claims priority from, U.S. patent application Ser. No. 10/467,689 filed on Aug. 8, 2003, the content of each of which is incorporated herein by reference.

BACKGROUND

The invention relates to dry shavers having a cutter blade and co-operating shear blade arrangement. The invention relates at least both to electric dry shavers of the type having a reciprocating cutter and a shear blade arrangement in the form of a perforated foil with a plurality of perforations, and also to dry shavers of the type having a rotary cutter member or blade underlying an external shear member provided with apertures for entry of the hairs to be cut. The invention also relates to cutter blade assemblies for such dry shavers.

The history of shaving to date has been the search for the ever-closer shave. However, certain skin and hair types develop "shaving bumps" or pseudofolliculitis barbae (PFB) in certain areas of the beard when a close shave is effected. This can occur where obliquely exiting hairs are cut tangentially too close to the skin surface causing them to re-enter into the skin where they may occasion inflammation. In shaving close, certain skin and hair types thus experience or develop inflammation due to re-entry into the skin of the closely shaved hairs.

U.S. Pat. No. 4,003,390 discloses the use of apertured guides or spacers between the razor head and the skin in order to cut or trim hairs at a predetermined distance from the skin.

U.S. Pat. No. 5,867,908 describes a rotary razor external cutting member having apertures of varying width in order to cut longer and shorter hairs more effectively and with less irritation, but ultimately achieving a "close" shave.

International Published Patent Application No. WO 98/35794 describes different shaving fields provided on an external cutting member, oriented in a fashion so that the longer hairs are cut first, or pre-shaved, by the outside fields before being properly close shaved by the inside fields.

European Patent No. 1 231 034 granted to the current applicant describes a rotary razor giving a variable height of cut, a specific embodiment of such envisaged using interchangeable shaving heads of different thicknesses and, in a further embodiment, a double shaving head containing an outer displaceable "dummy" shield so as to achieve a variable height of cut.

EP 1 231 034 also relates to a dry shaver having a variable thickness moveably shear foil mounted in a shaver head. An adjustment mechanism is provided to allow the user to select the required length of shave.

It is believed that none of the above razors and shavers completely addresses the inflammation problem discussed above. Accordingly, it would be desirable to provide a cutter blade assembly and dry shaver directed to overcoming the inflammation problems discussed hereinabove. It would further be desirable to provide a cutter blade assembly directed to achieving a variable height of cut by varying the thickness of the shear blade so as to achieve selectively a short or a long hair shave by using the same shear blade. In addition, it would be desirable to provide a rotary dry shaver which allows for a close shave in certain areas and a "longer" shave in other areas. Still further, it would be desirable to provide a dry shaver unit having an elongate flexible shear foil which allows for a variable height of cut.

SUMMARY OF THE INVENTION

The present invention relates to a thickening of the shear blade itself in order to firmly grasp and hold the hairs rigid at the skin surface in order to cut the hairs long at their point of exit, thereby addressing the problem of inflammation discussed above. The selection of the length of shave may be made by the user while shaving, simply by reorienting the shaver in relation to the surface to be shaved and no separate adjustment mechanism is required to select between the different lengths of shave.

According to a first aspect of the present invention, a dry shaver unit is provided that includes a housing and a cutter blade assembly mounted in the housing. The cutter blade assembly includes a cutter blade, and a cooperating shear blade arrangement, and the thickness of the shear blade varies over the surface thereof, such that the spacing between a portion of the skin engaging surface of the shear blade and the opposite face thereof is increased as compared with the spacing required to achieve a "close shave". The cutter blade assembly is mounted in the housing such that a plurality of portions of the shear blade having different thicknesses are simultaneously available for application to a surface to be shaved.

An advantage of this arrangement is that at least two different lengths of shave are provided by a single shear blade. At least two lengths of shave are therefore always immediately available to the user. The user may select the length of shave to be applied to the surface to be shaved depending on whether the area is prone to pseudofolliculitis barbae or not. The selection of the length of shave may be made by the user while shaving, simply by reorienting the shaver in relation to the surface to be shaved and no separate adjustment mechanism is required to select between the different lengths of shave.

According to a second aspect of the present invention, a cutter blade assembly is provided that includes a cutter blade and a co-operating shear blade arrangement in which provision is made for the spacing between a skin-engaging surface of the cutter blade assembly and regions of the shear blade arrangement which cooperate with the cutter blade to be increased as compared with the spacing required to achieve a "close shave". The cutter blade is preferably one or more rotary cutter blades, wherein each rotary cutter blade has a co-operating overlying shear blade and the spacing between a skin engaging surface of the shear blade and the opposite face thereof for co-operation with the rotary cutter blade (i.e. the cutter blade surface or side of the shear blade) varies about the circumference of the shear blade, such that the spacing between a portion of the skin engaging surface of the shear blade and the opposite face thereof is increased as compared with the spacing required to achieve a "close shave".

The cutter blade assembly of the present invention is therefore directed to achieving a variable height of cut by varying the thickness of the shear blade about its circumference or periphery so as to achieve selectively a short or a long hair shave using the same shear blade. Each cutter blade assembly is therefore capable of providing a long or short shave.

Preferably, the spacing between the skin engaging surface of the shear blade and the opposite face thereof is increased as compared with the spacing required to achieve a "close shave" over one third to one eighth of the circumference of the shear blade. More preferably, the spacing between the skin-engaging surface of the shear blade and the opposite face thereof is increased as compared with the spacing required to achieve a "close shave" over about one quarter of the circumference of the shear blade.

The cutter blade assembly may comprise at least two transition regions wherein the spacing between the skin-engaging surface of the shear blade and the opposite face thereof is increasing or decreasing, respectively. Starting from a portion of the assembly where the spacing between the skin-engaging surface of the shear blade and the opposite face thereof is at a minimum, the spacing increases at the transition regions. Conversely, starting from a portion of the assembly where the spacing between the skin-engaging surface of the shear blade and the opposite face thereof is at a maximum, the spacing decreases at the transition regions.

According to one embodiment of the cutter blade assembly, the spacing between the skin-engaging surface of the shear blade and the opposite face thereof varies gradually about the circumference of the shear blade, such that said transition regions are relatively long. In this embodiment, the spacing between the skin-engaging surface of the shear blade and the opposite face thereof may increase continuously and uniformly from a minimum spacing to a maximum spacing, and may decrease continuously and uniformly from the maximum spacing to the minimum spacing. Thus the shear blade may be tapered about its entire circumference, such that the transition regions extend over substantially the whole of the circumference of the shear blade.

An advantage of this arrangement is that the gradual tapering of the shear blade allows the hairs in non-problem areas of the beard to be shaven progressively closer and closer to the skin surface.

According to an alternative embodiment of the cutter blade assembly, the spacing between the skin-engaging surface of the shear blade and the opposite face thereof changes abruptly at two positions on the circumference of the shear blade, such that the transition regions are relatively short. Working around the circumference of the shear blade, the spacing between the skin-engaging surface and the opposite face thereof thus increases sharply at a first point on the circumference and decreases sharply at a second point on the circumference of the shear blade.

An advantage of this arrangement is that the transition between the "close shave" and "long shave" regions of the cutter blade assembly is easily felt by the user and is immediately clear to him. The user may thus easily apply the desired height of shave to each area of the skin surface to be shaved.

Preferably, the shear blade comprises a plurality of radially-oriented hair entry openings extending from the skin-engaging surface of the shear blade to the opposite face thereof.

Ideally, the shear blade comprises a plurality of substantially radially-oriented tines or struts, and a hair entry opening is provided between each pair of adjacent tines. The thickness of the tines varies about the circumference of the shear blade such that the spacing between a portion of the skin engaging surface of the shear blade and the opposite face thereof is increased as compared with the spacing required to achieve a "close shave". Each transition region may comprise between two and five tines or struts.

Preferably, the thickness of the shear blade at said portion, wherein the spacing between skin-engaging surface of the shear blade and the opposite face thereof is increased, is between about 100 microns (μm) and about 500 microns (μm). Thus, the thickness of the shear blade at the thickened portion is between about 100 microns (μm) and about 500 microns (μm). More preferably, the spacing between the skin-engaging surface of the shear blade and the opposite face thereof at the thickened portion is between about 150 microns (μm) and about 400 microns (μm). In a preferred embodiment, the spacing between the skin-engaging surface of the shear blade and the opposite face thereof at the thickened portion is between about 200 microns (μm) and about 300 microns (μm). Preferably, the spacing between the remainder of the skin-engaging surface of the shear blade and the opposite face thereof is less than 100 microns (μm). The spacing between the skin-engaging surface of the shear blade and the opposite face thereof is thus sufficiently increased over a portion of the shear blade to prevent the occurrence of pseudofolliculitis barbae.

In one embodiment of the cutter blade assembly, the shear blade comprises a substantially annular peripheral wall portion extending downwardly from the skin-engaging surface thereof; and the peripheral wall is also increased in height at said portion of the shear blade where the spacing between the skin engaging surface and the opposite face thereof is increased, to further raise said portion of the skin engaging surface of the shear blade.

According to an embodiment of the first aspect of the invention, there is provided a rotary dry shaver comprising a housing, and a plurality of cutter blade assemblies as described above mounted within the housing, wherein the cutter blade assemblies are arranged such that the portion of each assembly which has an increased spacing between the skin-engaging surface of the shear blade and the opposite face thereof is oriented centrally of the shaver such that said portions are arranged adjacent one another to provide a central raised shaving plane or platform.

The rotary dry shaver of the present invention may therefore be used to prevent or protect against inflammation caused by pseudofolliculitis barbae by using the central raised shaving plane (or platform) to purposely cut the hair long at a sufficient distance from the skin surface so as to prevent any possible re-entry into the skin of the close cut hairs.

According to a preferred embodiment, the rotary dry shaver comprises three cutter blade assemblies mounted within the housing in a trefoil arrangement. Preferably, the cutter blade assemblies are mounted in the housing such that a central portion of each assembly is tilted upwards relative to outwardly oriented portions of the cutter blade assembly.

Preferably, the cutter blade assemblies are moveably mounted within the housing such that the central portion of each shear blade is downwardly displaceable to allow outwardly oriented portions of the shear blade to engage the skin to achieve a "close shave".

It is a particular object of the present invention to provide a dry shaver in which the depth of cut is variable, so that hair to be cut may be left at a variable length over certain areas of the skin as required, in order, inter alia, to avoid the development of a shaving rash due to re-entry into the skin of too-short tangentially cut hairs exiting the skin at an acute angle. An advantage of this arrangement is that a single shaver may be used to perform both long and short shaves, without requiring replacement of parts or changing of settings by the user. The switch from long shave to short shave is simply effected by increasing the pressure with which the shaver is held against the skin surface.

Ideally, the shear blade of each cutter blade assembly is resiliently upwardly biased, such that each shear blade is resiliently downwardly displaceable within the shaver.

In one embodiment, each cutter blade assembly is moveably mounted within a frame, and each frame is moveably mounted within the housing. Each frame may be resiliently upwardly biased, such that each frame is resiliently downwardly displaceable within the shaver. A central portion of each frame may be greater in height than outwardly oriented portions of the frame, such that the central portion of each cutter blade assembly is tilted upwards relative to outwardly oriented portions of the cutter blade assembly. One or more stops may be provided within the housing to limit the downward displacement of the shear blades and/or the frames.

According to a further embodiment of the first aspect of the invention, there is provided a dry shaver unit comprising a housing and a cutter blade assembly mounted in the housing, the cutter blade assembly comprising a reciprocating cutter blade and shear blade arrangement; wherein the shear blade is an elongate flexible shear foil and the thickness of the foil varies along the elongate extent thereof, such that the spacing between a thickened portion of the skin engaging surface of the foil and the opposite face thereof is increased as compared with the spacing required to achieve a "close shave", and characterised in that said cutter blade assembly is mounted in the housing such that a plurality of portions of the foil having different thicknesses are simultaneously available for application to a surface to be shaved. Preferably, the thickness of the shear blade at a thickened portion, wherein the spacing between the skin-engaging surface of the shear foil and the opposite face thereof is increased, is between about 100 microns (μm) and about 500 microns (μm). More preferably, the spacing between the thickened portion of the skin-engaging surface of the foil and the opposite face thereof is between about 150 microns (μm) and about 400 microns (μm). In a preferred embodiment, the spacing between the thickened portion of the skin-engaging surface of the foil and the opposite face thereof is between about 200 microns (μm) and about 300 microns (μm). Preferably, the spacing between the remainder of the skin-engaging surface of the shear foil and the opposite face thereof is less than 100 microns (μm).

Preferably, the shear foil is fixedly mounted within the housing. In one embodiment, the shear foil is arcuate in shape, such that the shear foil has a curved, inverted U-shaped profile, and at least two portions of the foil are simultaneously available for application to a surface to be shaved. A first exposed portion of the shear foil (or first cutting face) having a first thickness is thus provided on one side of the shaver and a second shaving portion (or second cutting face) having a second thickness is provided on the opposite side of the shaver. The first exposed portion has a thickness of between about 150 (μm) microns and about 300 microns (μm) and the second exposed portion has a thickness of less than 100 microns (μm). In this embodiment, each portion may be selectively applied to the surface to be shaved by rotating the shaver about its longitudinal axis. Alternatively, each portion may be selectively applied to the surface to be shaved by inverting the shaver. Thus, the thicker portion of the foil may be applied to problem areas of the skin which are prone to pseudofolliculitis barbae, and the thinner portion may be applied to areas of the skin which are not prone to pseudofolliculitis barbae.

The shear foil may be tapered over its length, such that its thickness varies continuously and uniformly from one end to the other. A portion of intermediate thickness, that is, between the extremes at either end of the shear foil, may thus also be available for application to the surface to be shaved, for example, by holding the shaver unit perpendicular to the surface. Alternatively, the thickness of the shear foil may change abruptly at a point along the length of the foil, to give a relatively short transition region.

BRIEF DESCRIPTION OF THE DRAWINGS

The invention will now be described with reference to certain preferred embodiments thereof and the accompanying drawings, wherein.

DETAILED DESCRIPTION OF THE PREFERRED EMBODIMENT OF THE INVENTION

Figure 1:
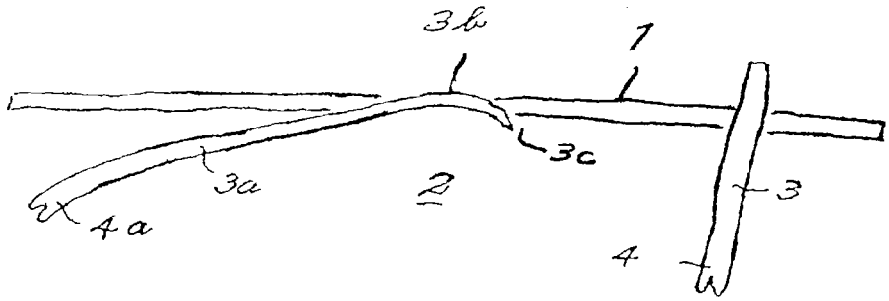
FIG. 1 is a diagrammatic representation of a portion of human skin, in the region of the surface of the skin, in section, showing inner and outer skin layers and hair growth, and representing also a particular condition in which an individual's body hair is subject to growth in a manner more horizontal than vertical.

FIG. 1 is a representation in sectional view of a portion of the surface of the skin of an individual. As shown in FIG. 1, the outer layer 1 of the skin is underlaid by an inner layer 2. Hairs 3 and 3*a* grow outwardly through the skin from respective root regions 4 and 4*a* and emerge through the outer layer 1 of the skin. In the normal way, as indicated by hair 3, a hair should emerge from the skin outer layer 1 and extend outwardly above the skin surface substantially at right angles to the skin surface. Depending on the region of the skin surface in question, certain hairs such as that designated by reference 3*a* in FIG. 1 may have a hair follicle which is oriented horizontally and almost parallel with the skin surface. When a hair emerges from such a follicle onto the skin surface, as indicated at reference 3*b*, it does so obliquely and in a highly tangential manner.

If an individual suffering from such tangential hair growth wishes to effect a close shave and cuts the hair relatively close to the skin outer surface, a condition known as pseudofolliculitis barbae may develop. This occurs when the hairs are cut too short such that the sharp, cut edge of the hair becomes engaged by the horny outer layer 1 of the skin and is redirected downwards into the dermis. The hair thus burrows back beneath the surface of the skin, as indicated at reference 3*c*, rather than emerging from the skin and growing externally in the normal manner. If growth then continues with the hair 3 running into and under the skin, the inevitable result is ingrowth of the hair accompanied by inflammation of the skin.

It is therefore preferable to prevent the development of any such inflammation and the present invention addresses this problem. The concept underlying the avoidance of such skin conditions is to cut the hair slightly above the surface of the skin in areas of the body surface where the possibility of such ingrowing conditions arising is likely to be greatest. The advantages of its being possible to cut hair in accordance with the principles of the present invention are not however limited only to skin conditions such as that illustrated with reference to FIG. 1, but the invention is also applicable to all skin circumstances where shaving bumps or other skin eruptions or imperfections militate against an excessively close shave, such as in the bikini area. The invention provides the user of a dry shaver with the ability to selectively cut body hair either tightly or to a greater length, depending on the region of the skin in question, i.e. the area currently being shaved.

Figure 2:
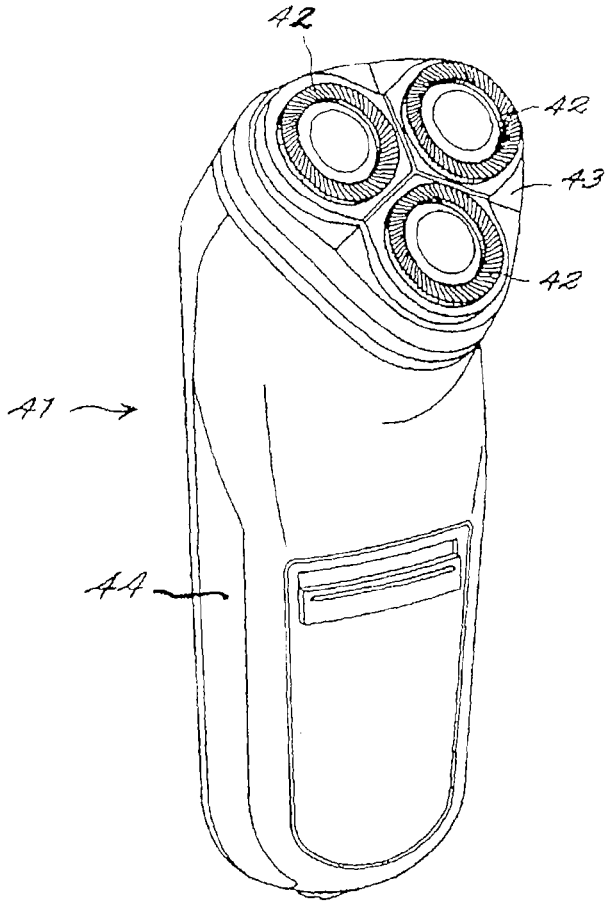
FIG. 2 is a pictorial view of a rotary shaver of known construction, to which the present invention may be applied.

Referring now to FIG. 2 of the drawings, there is shown a rotary dry shaver of generally conventional construction. The shaver 41 has a number of cutter blade assemblies 42, typically three as shown in the drawing, or alternatively two assemblies 42, in each case located at the cutting end face 43 of the shaver body 44. In such constructions, each cutter blade assembly 42 has an external or shear blade, which has hair entry apertures or slits and is underlaid, in the assembled condition, by a rotating cutter blade, which severs hairs extending into the cutting region of the cutter blade through the slits or perforations (apertures) of the shear blade. Each of the shear blades has a particular thickness or depth dimension of the hair entry slits or perforations, so as to provide for a corresponding depth of cut. In conventional dry shavers, the thickness of the shear blade is as small as possible so as to achieve the closest possible shave.

Figure 3:
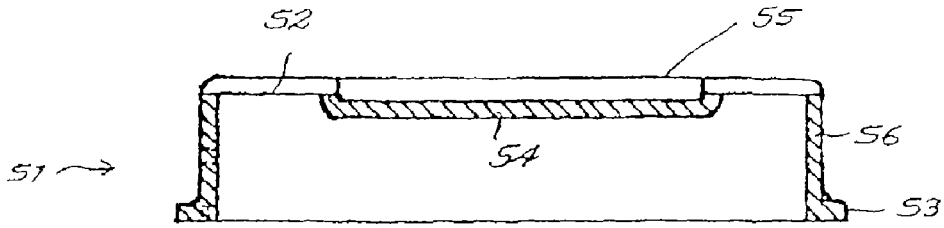
FIG. 3 is a side sectional view of a shear blade of conventional construction for use in the shaver of FIG. 2.

Referring now to FIG. 3, there is shown an external cutting member or shear blade 51 of generally conventional configuration. A cutter blade assembly 42 equipped with this type of shear blade 51 may be regarded as providing a minimum depth of cut, for a tight shave. As shown in this drawing, the shear blade 51, which is in the general shape of a top-hat, or an inverted cup, has a series of generally radially-oriented, optionally skewed, hair entry slits or apertures 52, in an outwardly-directed generally disc-shaped region 55 of the blade 51, which is upwardly-oriented when incorporated in a cutter blade assembly 42 mounted on a rotary dry shaver 41 as shown in FIG. 2. The outer surface of this disc-shaped region 55 of cutting member 51 comes into contact with the skin during a shaving operation. At the periphery of the disc, a generally annular peripheral wall portion 56 extends (downwardly in the mounted condition on shaver 41) to terminate in an externally-directed holding flange 53, by which the shear blade is secured in position on the shaver 41. Centrally of the generally disc-shaped region 55, radially inward of the slits 52, there is a provided a central dished portion 54, which is set back from the skin-engaging surface defined by the outer face of region 55 at the slots 52.

Figure 4:
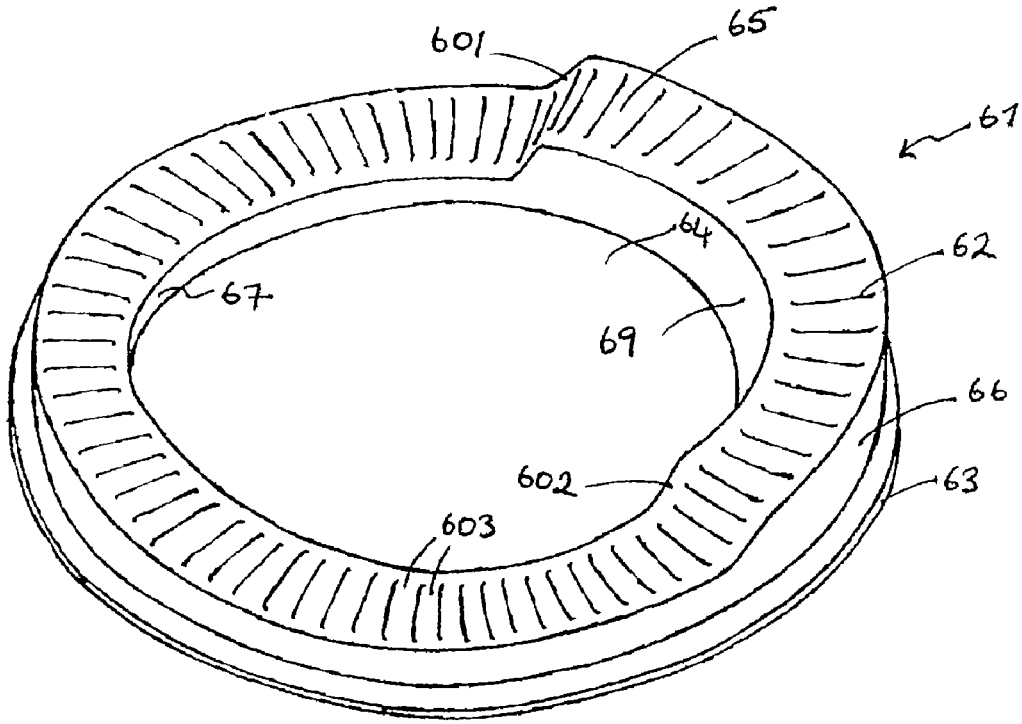
FIG. 4 is an isometric view of a shear blade of the cutter blade assembly according to a first embodiment of the present invention.
Figure 5:
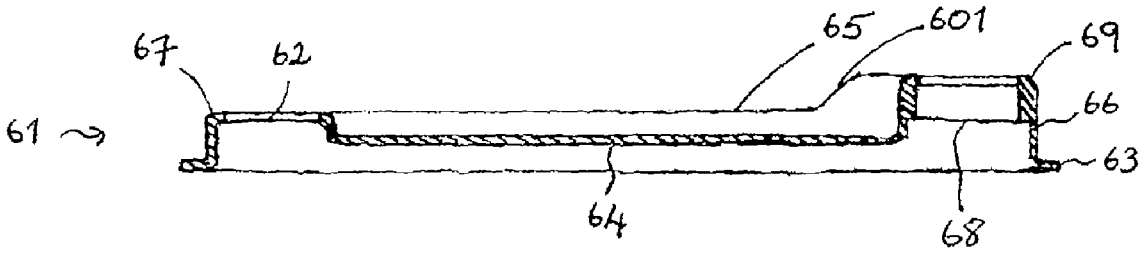
FIG. 5 is a side cross-sectional view of the shear blade of FIG. 4.

Referring now to FIGS. 4 and 5, shear blade 61 is generally similar in construction to blade 51, so that blades 51 and 61 are interchangeable on the dry shaver 41 of FIG. 2. Shear blade 61 has a series of generally radially-oriented, optionally skewed, hair entry slits or apertures 62, provided on a skin-engaging region 65 thereof. As shown in FIG. 4, the skin-engaging region 65 of shear blade 61 comprises a plurality of substantially radially-oriented tines or struts 603. A hair entry opening 62 is provided between each pair of adjacent tines. The skin-engaging region 65 is substantially annular in shape and is upwardly-oriented when incorporated in a cutter blade assembly and mounted on the rotary shaver 41. The outer surface of this skin-engaging region 65 of cutting member 61 thus comes into contact with the skin during a shaving operation. Similarly to shear blade 51, shear blade 61 is provided with an annular peripheral wall portion 66 which extends (downwardly in the mounted condition on shaver 41) to terminate in an externally-directed holding flange 63, by which the shear blade may be mounted on the shaver 41. Centrally of the skin-engaging region 65, radially inward of the slits 62, there is a provided a central portion 64, which is substantially saucer-shaped and is recessed from the skin-engaging surface defined by the outer face of region 65 at the slots 62.

In order to selectively provide for a more generous shave, in other words a less tight or close shave leaving a longer beard length, shear blade 61 varies in thickness about its circumference, as shown in FIGS. 4 and 5. The thickness of a portion of the skin-engaging region 65 of the shear blade 61 is increased relative to the remainder of the skin-engaging region of the shear blade, to create a raised portion 69. In the embodiment shown in FIGS. 4 and 5, the spacing between the skin-engaging surface of the shear blade and the opposite face thereof is increased over about one third of the circumference of the shear blade. This allows a longer or more generous shave to be achieved when the thicker or raised portion 69 of the shear blade is applied to the face and a closer shave to be achieved when the thinner portion 67 of the skin-engaging region is applied to the face.

The shear blade 61 has two transition regions 601 and 602 wherein the spacing between the skin-engaging surface of the shear blade and the opposite face 68 thereof varies or tapers. If one were to trace an imaginary path around the circumference of shear blade 61 in a clockwise direction, the spacing between the skin-engaging surface of the shear blade and the opposite face 68 thereof would increase at transition region 601 and decrease at transition region 602. In the embodiment shown, each transition region comprises three tines or struts 603.

The only dimensional difference between the shear blades 51 and 61 is in the thickness of the blade in the thicker or raised portion 69. The thickness of each of the tines or struts 603 in this portion of the shear blade 61 is thus increased relative to the remainder of the tines of the shear blade. In the embodiment shown in FIGS. 4 and 5, the thickness of the blade in the thicker or raised portion is about 250 microns. The thickness of blade 61 over the reminder of its circumference is less than 100 microns. Slits 62, flange 63 and central region 64 correspond to portions 52, 53 and 54 of the standard cutter 51 of FIG. 3. However, at portion 69 of shear blade 61, the slits 62 are substantially greater in depth than the slits at portion 67 of shear blade 61, since each slit 62 runs from the skin-engaging surface of the thickened portion through to the opposite face thereof. The slits in portion 69 are thus also greater in depth than the slits 52 of blade 51.

In an alternative embodiment of the shear blade, the peripheral wall may be greater in height at said portion of the shear blade where the spacing between the skin engaging surface and the opposite face thereof is increased, so as to further raise that portion of the skin engaging surface of the shear blade. Accordingly, when the raised portion 69 of shear blade 61 is applied to the face, the hairs are cut at a longer length than in the case of the blade 51. In use of this embodiment of the invention, the raised portion 69 of shear blade 61 is to be applied to skin areas where the cut is not to be too tight, so as to avoid the dermatological and other skin problems previously identified, while the thinner portion 67 of shear blade 61 may be used in a similar manner to shear blade 51 to achieve a tight shave and good appearance where this does not create any skin hazard or potential damage.

Figure 6:
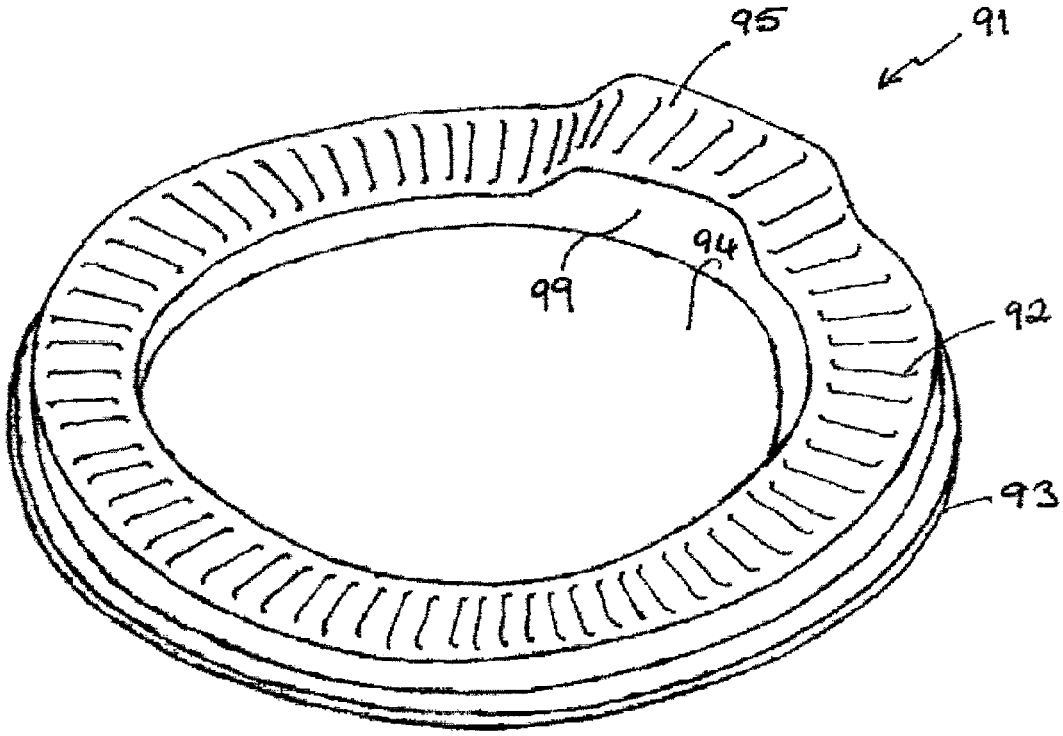
FIG. 6 is an isometric view of a shear blade of a rotary cutter blade assembly according to a second embodiment of the present invention.

Referring now to FIG. 6, there is illustrated a shear blade 91 according to a second embodiment of the present invention. Shear blade 91 is generally similar in construction to blade 61 and comprises a series of generally radially-oriented, optionally skewed, hair entry slits or apertures 92, provided on a skin-engaging region 95 thereof. In order to selectively provide for a more generous shave, in other words a less tight or close shave leaving a longer beard length, shear blade 91 varies in thickness about its circumference, as shown in FIG. 6.

The thickness of a portion of the skin-engaging region 95 of the shear blade 91 is increased relative to the remainder of the skin-engaging region of the shear blade, to create a raised portion 99. In the embodiment shown in FIG. 6, the spacing between the skin-engaging surface of the shear blade and the opposite face thereof is increased over about one eighth of the circumference of the shear blade.

In the embodiment shown in FIG. 6, the thickness of the blade 91 at the raised portion 99 is about 250 microns. The thickness of the blade over the remainder of its circumference is less than 100 microns.

Figure 7:
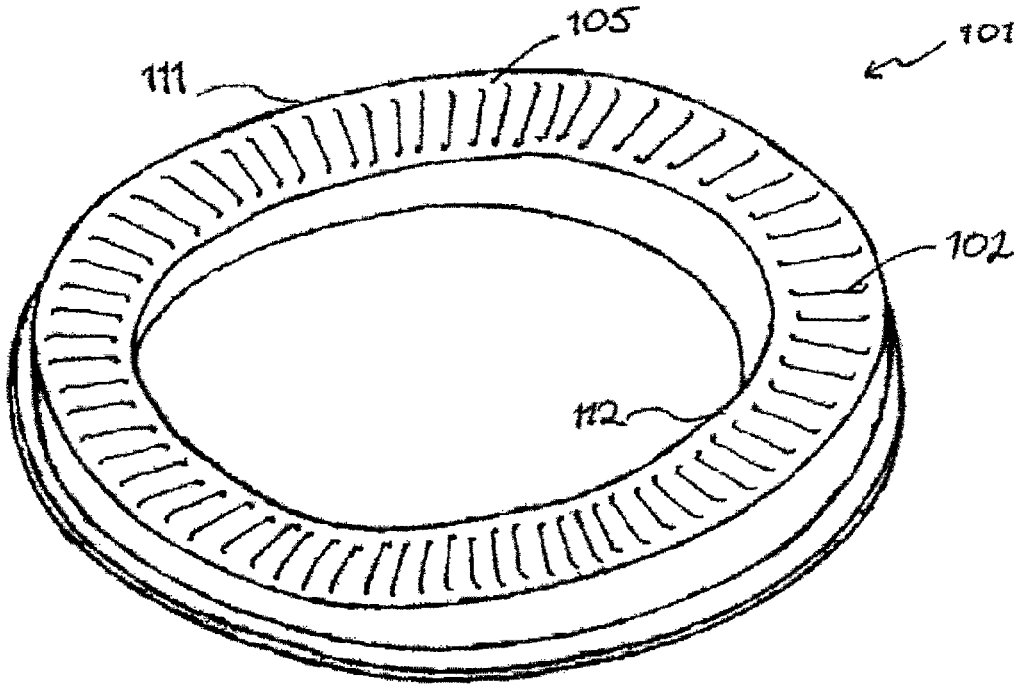
FIG. 7 is an isometric view of a shear blade of a rotary cutter blade assembly according to a third embodiment of the present invention.

Referring now to FIG. 7, there is illustrated a shear blade 101 according to a third embodiment of the present invention. Shear blade 101 is generally similar in construction to blade 61 and comprises a series of generally radially-oriented, optionally skewed, hair entry slits or apertures 102, provided on a skin-engaging region 105 thereof. In order to selectively provide for a more generous shave, in other words a less tight or close shave leaving a longer beard length, shear blade 101 varies in thickness about its circumference, as shown in FIG. 7.

In the embodiment shown in FIG. 7, the shear blade 101 is tapered about its entire circumference, such that the transition regions 111, 112 extend over substantially the whole of the circumference of the shear blade. The spacing between the skin-engaging surface 105 of the shear blade 101 and the opposite face thereof increases continuously and uniformly from a minimum spacing to a maximum spacing, and decreases continuously and uniformly from the maximum spacing to the minimum spacing.

Figure 8:
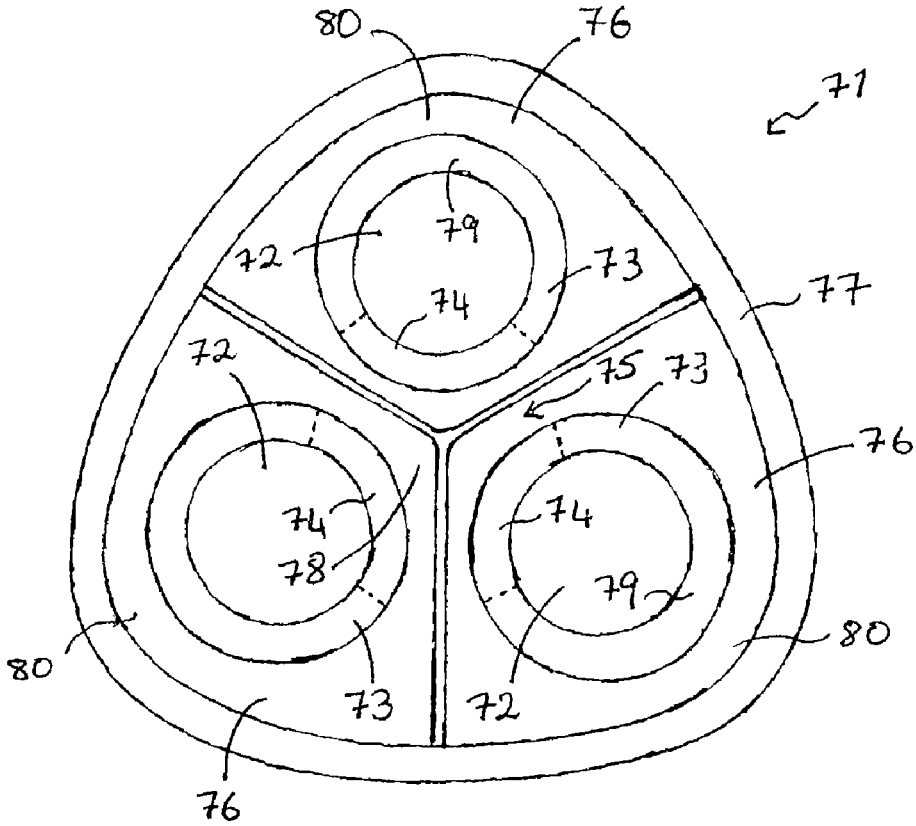
FIG. 8 is a front elevation view of a rotary shaver head in which three cutter blade assemblies according to the present invention are mounted to provide a central raised shaving platform.
Figure 9:
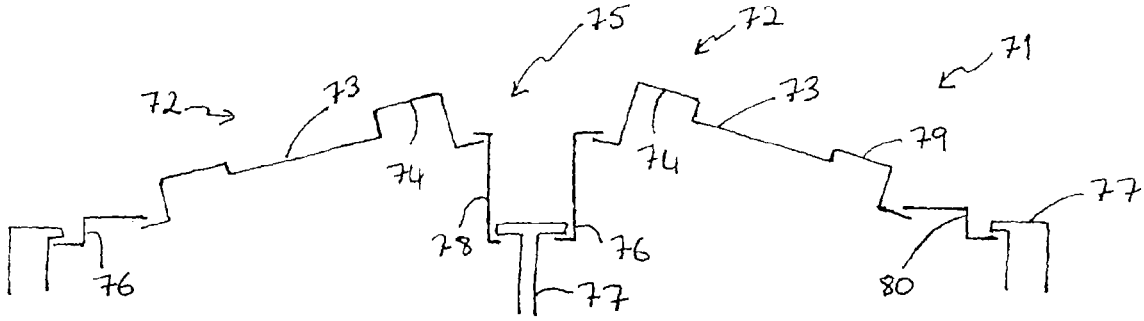
FIG. 9 is a diagrammatic view in section of the rotary shaver head of FIG. 8 in which the central raised shaving platform is in its raised condition.
Figure 10:
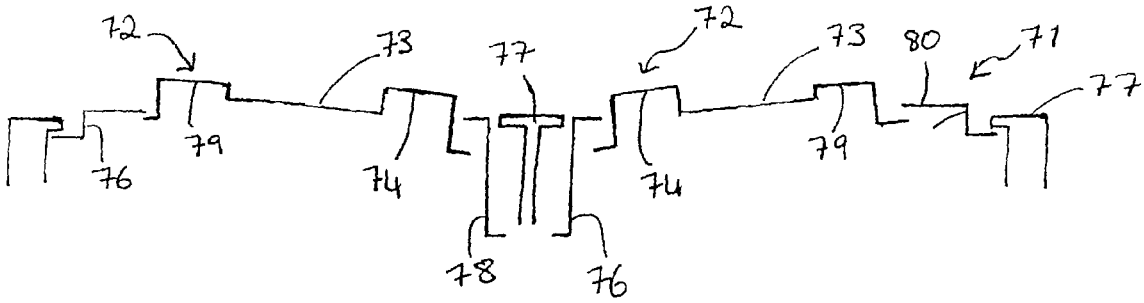
FIG. 10 is a side cross-sectional view of the rotary shaver head of FIG. 9, in which the central raised shaving platform has been depressed.

FIGS. 8, 9 and 10 illustrate a shaver head 71 of a rotary dry shaver according to an embodiment of the invention in a second aspect. The cutting drive and mounting arrangements of the rotary shaver of the invention are generally in accordance with substantially conventional arrangements well-known in the industry and only the particular deviations from such constructions required by the present invention are now described in detail. The rotary shaver comprises three cutter blade assemblies 72 mounted in a trefoil arrangement within an outer housing 77, which together form a shaver head 71. Each cutter blade assembly includes a shear blade 73 as described above with reference to FIGS. 4 and 5, and an associated rotary cutter blade. As shown in FIGS. 9 and 10, each shear blade 73 is moveably mounted within a frame 76, which in turn is moveably mounted within the shaver head housing 77. As shown in FIG. 8, the cutter blade assemblies 72 are arranged such that the portion 74 of each assembly which has an increased spacing between the skin-engaging surface of the shear blade and the opposite face thereof (that is, the thicker portion) is oriented centrally of the shaver such that said portions are arranged adjacent one another to provide a central raised shaving plane or platform 75.

The shear blades 73 are resiliently biased upwards, that is, towards the skin-engaging region of the shaver head, the biasing means being substantially conventional and not illustrated. Each shear blade is therefore resiliently downwardly displaceable within the shaver. The frames 76 are also resiliently biased upwards in a similar manner to the shear blades 73. The frames 76 are thus also resiliently downwardly displaceable within the shaver. The biasing means is such that the shear blade 73 and the frames 76 are effectively floatingly mounted within the housing 77.

As illustrated in FIG. 9, each frame 76 is greater in height at its centrally oriented portion 78 than at the outwardly oriented portions 80 thereof. Since the shear blades are biased upwards and are retained in the shaver by the frames 76 within the outer housing 77, each of the cutter blade assemblies 72 is mounted in the shaver head 71 at an angle to the horizontal, such that the central (thicker) portion 74 of each assembly is tilted upwards relative to the outwardly oriented (thinner) portions 79 of each assembly. Thus, each shear blade 73 is thicker at its central portion 74 than at its outwardly oriented portions 79, and is also tilted upwards at its the central portions 74 relative to the outwardly oriented portions 79. When the shaver is first applied to the skin surface to be shaved, the increased height of the shear blades and the upward tilt ensures that only the central raised shaving platform 75 engages the skin, providing for a longer or more generous shave.

In an alternative embodiment, in addition to each shear blade 73 being thicker at its central portion 74 than at its outwardly oriented portions 79, and being tilted upwards at its the central portions 74 relative to the outwardly oriented portions 79, the peripheral wall portion of each shear blade 73 is also increased in height at the central portion 74 relative to the outwardly oriented portions 79 to further raise the central shaving platform 75. When the shaver is first applied to the skin surface to be shaved, the increased thickness of the shear blades, the upward tilt and the increased wall height ensure that only the central raised shaving platform 75 engages the skin, providing for a longer or more generous shave.

In order to achieve a close shave, it is necessary to bring the outwardly oriented (thinner) portions 79 of the shear blades into contact with the skin surface. This may be done by exerting pressure on the central raised shaving plane 75, that is, by pressing the shaver head 71 more firmly against the skin surface to be shaved. Pressure exerted on the central raised shaving plane 75 causes each moveably mounted shear blade and associated moveable frame to be displaced downwardly into the shaver at a central portion thereof thereby allowing the outwardly oriented portions of the shear blades to engage the skin as shown in FIG. 10. Since the shear blades are thinner at their outwardly oriented portions, the spacing between the skin-engaging surface of each of the shear blades and the opposite face thereof for co-operation with the associated cutter blade is relatively small, and a close shave may be effected.

In use, when the shaver is first applied to the skin surface to be shaved, the central raised platform 75 contacts the skin and may be used to carry out a long or generous shave of the skin surface. Skin irritation and inflammation due to pseudofolliculitis barbae may thus be avoided in areas where hair growth is tangential to the skin. In order to effect a tight shave in areas of the skin where hair growth is perpendicular to the skin, and which are thus not prone to pseudofolliculitis barbae, the user presses the shaver slightly more firmly against the skin. This causes the central raised portions 74 of the shear blades 73 and/or the frames 76 to pivot against their biasing means so that they are tilted downwards, that is, into the shaver body.

The thicker raised portions 74 of the shear blades 73 (and the central portions 78 of the frames 76) are thus depressed into the shaver body, such that their skin-engaging surfaces are lowered to substantially the same level as the skin-engaging surfaces of the outer portions 79. Each shear blade is thus brought to a horizontal or near horizontal position as shown in FIG. 10 of the drawings. The thinner outwardly oriented portions 79 of the shear blades 73 are thereby allowed to engage the skin. The spacings between the skin-engaging surfaces of the shear blades and the opposite faces thereof in these regions of the shaver are small and a tight shave may therefore be achieved as with a conventional rotary shaver.

Figure 11:
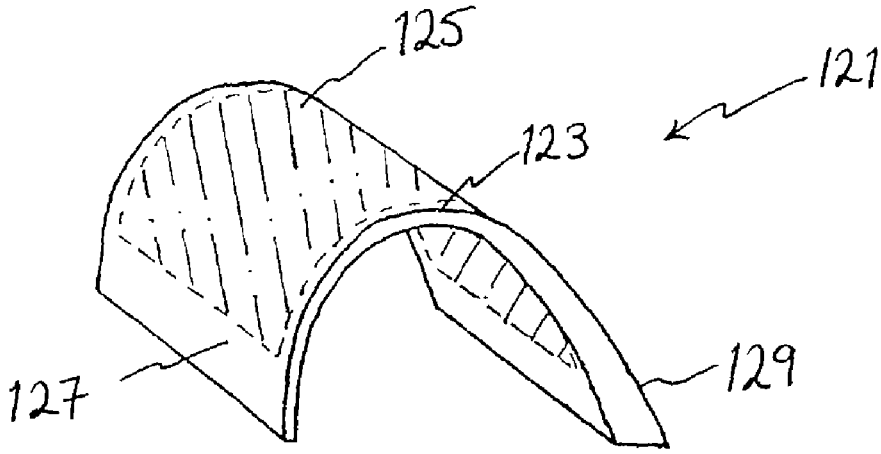
FIG. 11 is a perspective view of a shear foil of a dry shaver unit according to an embodiment of the invention.

Referring now to FIG. 11, there is illustrated a shear foil 121 of a dry shaver unit according to an embodiment of the first aspect of the invention. The thickness of the foil 121 varies along the elongate extent thereof, such that a plurality of portions 129,127 having different thicknesses are provided. The shear foil 121 may be mounted in a shaver housing such that the plurality of portions of the foil 129, 127 having different thicknesses are simultaneously available for application to the skin. In the embodiment shown in FIG. 11, the thickness of the foil 121 at the thicker portion 129 is about 250 microns. The thickness of the foil at the thinner portion 127 is less than 100 microns.

When mounted in the shaver housing, each portion 129, 127 may be selectively applied to the surface to be shaved by rotating the shaver about its longitudinal axis. Alternatively, each portion 129, 127 may be selectively applied to the surface to be shaved by inverting the shaver. Thus, the thicker portion of the foil may be applied to problem areas of the skin which are prone to pseudofolliculitis barbae, and the thinner portion may be applied to areas of the skin which are not prone to pseudofolliculitis barbae.

In the embodiment shown in FIG. 11, the shear foil is tapered over its length, such that its thickness varies continuously and uniformly from one end to the other. A portion of intermediate thickness 123, is thus available for application to the skin, for example, by holding the shaver unit perpendicular to the surface. In alternative embodiments, the thickness of the foil may change abruptly at a point along the length of the foil, to give a relatively short transition region.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A cutter blade assembly for a rotary shaver comprising:

a rotary cutter blade having a cutter blade surface for shaving hair extending from a skin of a user;

a circular, disk-shaped shear blade having an annular skin-engaging surface on one side thereof and an inner surface on the other side thereof, the annular skin-engaging surface having an inner circular edge and an outer circular edge, the shear blade overlaying the cutter blade such that the annular skin-engaging surface is spaced from the cutter blade surface; and a plurality of radially-oriented tines extending from the inner circular edge to the outer circular edge of the annular skin-engaging surface, the plurality of radially-oriented tines defining a plurality of radially-oriented hair entry openings for holding hairs at the surface of the skin and for aligning the hairs relative to the cutter blade surface, the shear blade disposed relative to the cutter blade to define a spacing between the cutter blade surface of the cutter blade and the skin-engaging surface of the shear blade, wherein the spacing increases continuously and uniformly from a minimum spacing at a first portion of the cutter blade assembly to a maximum spacing at a second portion of the cutter blade assembly wherein the first and second portions are arranged at substantially diametrically opposite regions of the circumference of the shear blade.

2. A cutter blade assembly as claimed in claim 1, wherein:

the shear blade comprises a substantially annular peripheral wall portion extending downwardly from the skin-engaging surface thereof, wherein the peripheral wall is increased in height at the second side of the cutter blade assembly.

3. A dry shaver unit comprising:

a housing; and at least one cutter blade assembly mounted in the housing, the cutter blade assembly comprised of:

a cutter blade having a cutter blade surface for shaving hair extending from a skin of a user;

a circular, disk-shaped shear blade having an annular skin-engaging surface on one side thereof and an inner surface on the other side thereof, the annular skin-engaging surface having an inner circular edge and an outer circular edge, the shear blade overlaying the cutter blade such that the annular-skin engaging surface is spaced from the cutter blade surface; and a plurality of radially-oriented tines extending from the inner circular edge to the outer circular edge of the annular skin-engaging surface, the plurality of tines defining a plurality of radially-oriented hair entry openings for holding hairs at the surface of the skin and for aligning the hairs relative to the cutter blade surface, the shear blade disposed relative to the cutter blade to define a spacing between the cutter blade surface of the cutter blade and the skin-engaging surface of the shear blade, wherein the spacing increases continuously and uniformly from a minimum spacing at a first portion of the cutter blade assembly to a maximum spacing at a second portion of the cutter blade assembly wherein the first and second portions are arranged at substantially diametrically opposite regions of the circumference of the shear blade.

4. A dry shaver as claimed in claim 3, comprising:

a plurality of cutter blade assemblies mounted within the housing;

wherein the cutter blade assemblies are arranged to orientate the second portion of each cutter blade assembly toward a center of the shaver to define a central-raised shaving platform.

5. A dry shaver as claimed in claim 4, wherein the cutter blade assemblies are moveably mounted within the housing such that the second portion of each cutter blade assembly is downwardly displaceable to allow the first portion of each cutter blade assembly to engage the skin to achieve a "close shave".

6. A dry shaver as claimed in claim 5, wherein the shear blade of each cutter blade assembly is resiliently upwardly biased, such that each shear blade is resiliently downwardly displaceable within the shaver.

7. A dry shaver as claimed in claim 4, wherein each cutter blade assembly is moveably mounted within a frame, and each frame is moveably mounted within the housing.

8. A dry shaver as claimed in claim 7, wherein each frame is resiliently upwardly biased, such that each frame is resiliently downwardly displaceable within the shaver.

9. A dry shaver as claimed in claim 7, wherein a central portion of each frame is greater in height than outwardly oriented portions of the frame, such that the central portion of each cutter blade assembly is tilted upwards relative to outwardly oriented portions of the cutter blade assembly to allow a longer shave in the unbiased state.

10. A dry shaver as claimed in claim 3, wherein the cutter blade assemblies are mounted in the housing such that the second portion of each cutter blade assembly is tilted upwards relative to the first portion of each cutter blade assembly.

* * * * *

UNITED STATES PATENT AND TRADEMARK OFFICE

CERTIFICATE OF CORRECTION

PATENT NO. : 8,061,040 B2
APPLICATION NO. : 12/126198
DATED : November 22, 2011
INVENTOR(S) : Patrick Joseph Walls It is certified that error appears in the above-identified patent and that said Letters Patent is hereby corrected as shown below:

Title Page, Item (63) Related U.S. Application Data, line 2 the word "which", should read --and--.

Signed and Sealed this
Seventh Day of February, 2012

David J. Kappos

David J. Kappos
*Director of the United States Patent and Trademark Office*